United States Patent [19]

Fallier, Jr. et al.

[11] 4,353,012

[45] Oct. 5, 1982

[54] PULSE INJECTION STARTING FOR HIGH INTENSITY DISCHARGE METAL HALIDE LAMPS

[75] Inventors: Charles N. Fallier, Jr., Westford; Joseph M. Proud, Wellesley Hills, both of Mass.

[73] Assignee: GTE Laboratories Incorporated, Waltham, Mass.

[21] Appl. No.: 256,865

[22] Filed: Apr. 24, 1981

[51] Int. Cl.[3] ..... H05B 37/00

[52] U.S. Cl. ..... 315/289; 315/209 CD; 315/241 R; 315/DIG. 7

[58] Field of Search ..... 315/289, 290, DIG. 7, 315/209 CD, 241 R, 45

[56] References Cited

U.S. PATENT DOCUMENTS

| | | | |
|---|---|---|---|
| 2,737,612 | 3/1956 | Sims | 315/289 |
| 3,289,015 | 11/1966 | Fitch et al. . | |
| 3,463,965 | 8/1969 | Peek | 315/289 |
| 3,963,958 | 6/1976 | Nuckolls | 315/289 |
| 4,325,004 | 4/1982 | Proud | 315/45 |

*Primary Examiner*—Harold A. Dixon

*Attorney, Agent, or Firm*—J. Stephen Yeo

[57] ABSTRACT

A light source wherein a spiral line pulse generator, having an output coupled to one electrode of a metal halide discharge lamp and an input for coupling to a source of lamp operating power, provides high voltage, short duration lamp starting pulses. The spiral line pulse generator includes two conductors and two insulators, each in the form of an elongated sheet, in an alternating arrangement which is rolled together in a spiral configuration having a plurality of turns. The high voltage, short duration pulse is provided upon closure of a low inductance switch coupled between the conductors. A thermal switch can be utilized to bypass the spiral line pulse generator after lamp starting. The spiral line pulse generator can be enclosed within the lamp base of the light source.

11 Claims, 8 Drawing Figures

PULSE INJECTION STARTING FOR HIGH INTENSITY DISCHARGE METAL HALIDE LAMPS

BACKGROUND OF THE INVENTION

This invention relates to starting of high intensity discharge lamps and, more particularly, to a new and improved light source wherein a spiral line pulse generator is used to start a high intensity discharge metal halide lamp.

Conventional high intensity discharge metal halide lamps include two main electrodes at opposite ends of a discharge tube and an auxiliary starting electrode associated with one of the main electrodes. A starting circuit applies a high voltage between the main electrodes of the lamp and, simultaneously, between the starting electrode and its associated main electrode. A discharge is initiated between the starting electrode and the main electrode by the starting circuit and then transfers to provide a discharge between the two main electrodes. After a high intensity discharge is formed within the discharge tube, the voltage between the electrodes drops and the starting circuit is no longer operative.

While the starting electrode in metal halide lamps provides generally satisfactory operation, it has certain disadvantages. The complexity and cost of manufacturing the lamp are increased when the starting electrode is used. In addition, the lamp seal in the region of the starting electrode is adversely affected by an electrolysis process when a potential difference exists between the starting electrode and the main electrode. The degradation of the seal can eventually lead to lamp failure. It is known that this problem can be alleviated by connecting a thermal switch, which closes after starting of the lamp, between the main electrode and the starting electrode. However, the thermal switch adds to the overall cost and complexity of the lamp assembly. It is, therefore, desirable to provide a starting arrangement for metal halide lamps wherein the starting electrode can be eliminated.

The spiral line pulse generator, disclosed by R. A. Fitch et al. in U.S. Pat. No. 3,289,015, issued Nov. 29, 1966, is a device capable of storing electrical energy and, upon momentary short circuiting of a pair of terminals, of providing a high amplitude pulse. The spiral line pulse generator can, when properly utilized, provide the dual functions of storage and voltage multiplication. The spiral line pulse generator is a transient field reversal device which provides a roughly triangular pulse. Its peak voltage is a multiple of the initial charging voltage. The use of a spiral line pulse generator to start high pressure sodium lamps is disclosed in U.S. Pat. No. 4,325,004 No. 193,787, filed Oct. 2, 1980 and assigned to the assignee of the present application. The output of the spiral line pulse generator is coupled to a conductor, or starting aid, located in close proximity to an outer surface of the discharge tube. In the case of metal halide lamps, it has been found undesirable to locate conductors in close proximity to the central portion of the discharge tube, thereby ruling out the use of a starting aid to assist in initiating discharge.

SUMMARY OF THE INVENTION

According to the present invention there is provided a light source comprising a high pressure discharge lamp and a starting circuit. The discharge lamp includes a discharge tube having electrodes sealed therein at opposite ends and enclosing a fill material which emits light during discharge. The starting circuit includes a spiral line pulse generator including two conductors and two insulators, each in the form of an elongated sheet, in an alternating and overlapping arrangement which is rolled together in a spiral configuration having a plurality of turns. The spiral line pulse generator includes an output terminal coupled to one of the electrodes of the lamp and a pair of input terminals. One of the input terminals and the other of the electrodes of the lamp are adapted for coupling to a source of lamp operating power and for delivering lamp operating power, received from the source, through the spiral line pulse generator to the discharge lamp. The starting circuit further includes means for applying a first voltage between the conductors of the spiral line pulse generator and means for switching the conductors from the first voltage therebetween to a second voltage therebetween in a time interval which is much shorter than the transit time of electromagnetic waves through the spiral line pulse generator. After operation of the means for switching, the spiral line pulse generator provides, at its output terminal, a high voltage, short duration pulse of sufficient energy to initiate discharge in the discharge lamp. The light source can further include means for delivering lamp operating power directly to the one electrode of the discharge lamp after initiation of discharge in the lamp. The light source can further include a light transmitting envelope enclosing the discharge lamp and a lamp base enclosing the starting circuit.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
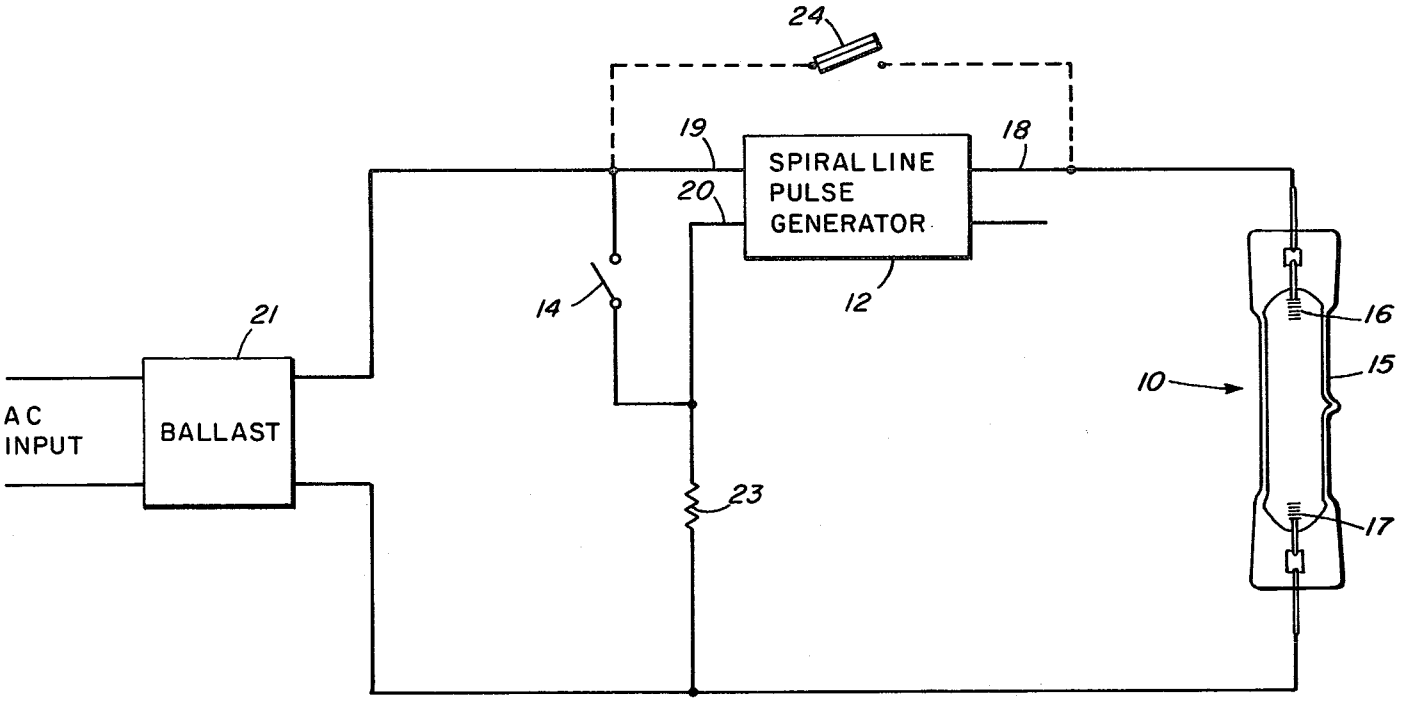
FIG. 1 is a schematic diagram of a light source in accordance with the present invention.

A high intensity light source in accordance with the present invention is shown in schematic form in FIG. 1 and includes a high pressure discharge lamp 10, a spiral line pulse generator 12 and a switch 14. The discharge lamp 10 is a high intensity discharge metal halide lamp and includes a discharge tube 15 having electrodes 16,17 sealed therein at opposite ends. The spiral line pulse generator 12 includes an output terminal 18 which is coupled to the electrode 16 of the discharge lamp 10.

The switch 14 is coupled across input terminals 19,20 of the spiral line pulse generator 12. A source of lamp operating power, such as a ballast 21, has one output terminal coupled to the input terminal 19 of the spiral line pulse generator 12. The other output terminal of the ballast 21 is coupled to the electrode 17 of the discharge lamp 10. A resistor 23 is coupled between the input terminal 20 of the spiral line pulse generator 12 and the electrode 17 of the discharge lamp 10. The ballast 21 can be a conventional metal halide lamp ballast such as a type 71A6051 supplied by Advance Transformer.

In a manner which is fully described hereinafter, the spiral line pulse generator 12 is charged through the resistor 23 and, after closure of the switch 14, provides at its output a high voltage, short duration pulse which initiates discharge in the discharge lamp 10. The ballast 21 receives input power, such as 60 Hz, 115 volts, from an ac distribution system and supplies suitable lamp operating power at its output. Lamp operating power from the ballast 21 passes through the spiral line pulse generator 12 from the input terminal 19 to the output terminal 18 and is supplied to the discharge lamp 10. An optional thermal switch 24 is connected between the input terminal 19 and the output terminal 18 of the spiral line pulse generator 12 and senses the temperature of the discharge lamp 10. When the discharge lamp 10 reaches a predetermined temperature, the thermal switch 24 closes and bypasses the spiral line pulse generator 12, thereby delivering lamp operating power directly to the discharge lamp 10.

The discharge lamp 10 is a conventional high intensity discharge metal halide lamp except that no starting electrode is included. The discharge tube 15 is typically fused silica. The discharge tube 15 contains a noble gas at low pressure and various volatile fill materials including mercury and one or more metal halide, typically metal iodides. The discharge current flows between the electrodes 16,17 after discharge has been initiated by a high voltage pulse.

Figure 2:
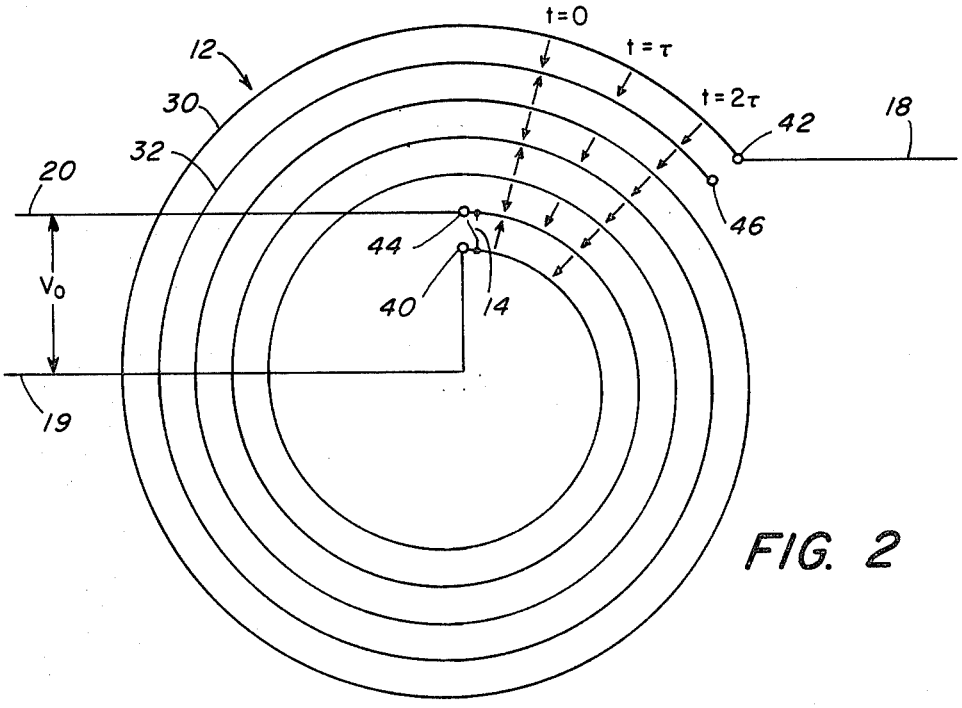
FIG. 2 is a simplified schematic diagram of a spiral line pulse generator.
Figure 3:
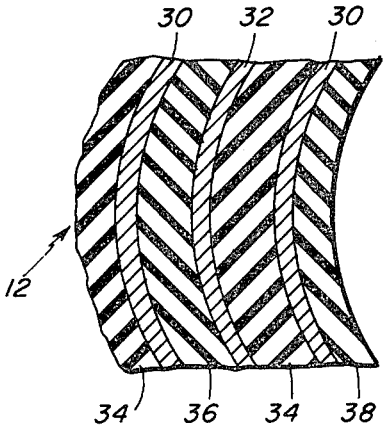
FIG. 3 is a partial cross-sectional view of the spiral line pulse generator shown in FIG. 2.

The spiral line pulse generator 12 is shown in simplified form in FIG. 2 for ease of understanding. A pair of conductors 30 and 32 in the form of elongated sheets of conductive material are rolled together to form a multiple turn spiral configuration. FIG. 3 is a partial cross-sectional view of the spiral line pulse generator 12 illustrating the layered construction of the device. A four layered arrangement of alternating conductors and insulators, including the conductors 30 and 32 and a pair of insulators 34 and 36, is rolled onto a form 38 in a multiple turn spiral configuration. The form 38 provides mechanical rigidity. The conductors 30 and 32 are separated by dielectric material at every point in the spiral configuration.

Figure 4:
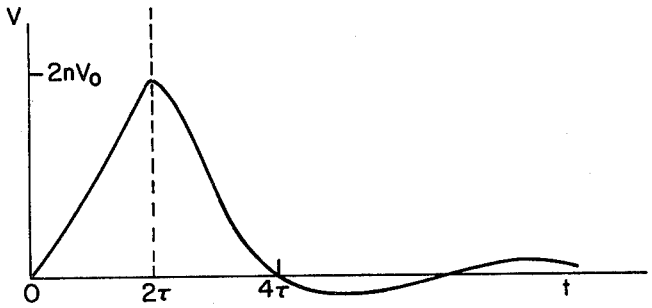
FIG. 4 is a graphic representation of the voltage output of the spiral line pulse generator of FIG. 2.

The operation of the spiral line pulse generator 12 can be described with reference to FIG. 2, which schematically shows the conductors 30 and 32. The conductor 30 runs from point 40 to point 42 while the conductor 32 runs from point 44 to point 46. In the present example, the switch 14 is coupled between the conductors 30 and 32 at or near the points 40 and 44. A voltage $V_0$ is applied between the conductors 30 and 32. Prior to the closing of the switch 14, the conductor 30 has a uniform potential between the points 40 and 42 and the conductor 32 has a uniform potential between the points 44 and 46 and the voltage difference between the innermost and the outermost turns of the spiral configuration is at most $V_0$. This can be seen by summing the electric field vectors at time t=0 as shown in FIG. 2. When the switch 14 is rapidly closed, a field reversing wave propagates along the transmission line formed by the conductors 30 and 32. When the wave reaches the points 42 and 46, at time $t=\tau$, the potential difference between the points 42 and 40 is $nV_0$, where n is the number of turns in the spiral configuration, due to the absence of cancelling static field vectors. As is well known, the propagating wave undergoes an in-phase reflection at the points 42 and 46 when these points are terminated in a high impedance or are open circuited as shown in FIG. 2. This results in an additional increase in the potential difference between the innermost and outermost conductors with a maximum occurring at time $t=2\tau$ at which time the field vectors are aligned as shown in FIG. 2. The output voltage waveform of the spiral line pulse generator 12 is shown in FIG. 4. The output taken between point 42 or 46 and point 40 reaches a maximum voltage of $2nV_0$ at $t=2\tau$ after the closure of the switch 14. The operation of the spiral line pulse generator is described in further detail in U.S. Pat. No. 3,289,015 and in Fitch et al., "Novel Principle of Transient High Voltage Generation," Proc. IEE, Vol. 111, No. 4, April 1964.

The operation and properties of the spiral line pulse generator 12 can be expressed in terms of the following parameters:

$V_0$—Charging voltage
$V_m$—Peak pulse voltage
n—Number of turns
V(t)—Transient voltage waveform
$\tau$—Transit time in spiral line
D—Diameter of spiral
v—Velocity of propagation in spiral
W—Width of line composing spiral
d—Thickness of dielectric
c—Velocity of EM waves in vacuum
$C_0$—Static capacitance of line
C—Effective output capacitance
$Z_0$—Impedance of line composing spiral
k—Relative dielectric constant
$\epsilon_o$—Dielectric constant in vacuum
$\mu$—Permeability of dielectric
L—Inductance of fast switch
$\delta$—Thickness of build-up
E—Energy available in spiral line Relationships descriptive of the output pulse are given by:

$$V_m = 2nV_0 \tag{1}$$

$$V(t) = (nt/\tau)V_0 \quad 0 < t < 2\tau \tag{2}$$

$$V(t) = 2n\left(1 - \frac{t-2\tau}{2\tau}\right)V_0 \quad 2\tau < t < 4\tau \tag{3}$$

$$\tau = n\pi D/v,\ v = ck^{-\frac{1}{2}} \tag{4}$$

The capacitance of the spiral line and its effective output capacitance are given by:

$$C_0 = \pi nk\epsilon_0 DW/d \tag{5}$$

$$C = C_0/(2n)^2 \tag{6}$$

The stored energy is:

$$E = C_0V_0^2/2 \tag{7}$$

The characteristic impedance of the strip line composing the spiral is:

$$Z_0=(\mu/k\epsilon_0)^{\frac{1}{2}}d/W \quad (8)$$

In optimizing performance of the spiral line pulse generator 12, it is important to utilize low loss dielectric materials and conductors in order that the propagating wave maintain a fast risetime compared to the transit time $\tau$ of electromagnetic waves between the innermost turn and the outermost turn of the spiral line pulse generator. It is additionally important to maintain a large ratio of diameter to winding buildup ($D/\delta$) and to provide for a very low inductance switch to insure that the voltage between the conductors is switched in a time interval which is much shorter than $\tau$. The maximum permissible value of inductance for the switch 14 is determined from the approximation known in the art that closure risetime is approximately equal to $L/Z_0$. Therefore, the following inequality must be met: $L<<\tau Z_0$. For a typical design, L, the inductance of the switch, is on the order of one nanohenry or less.

When the spiral line pulse generator 12 is located in a base region of the light source or within an outer jacket of the light source, it must meet certain additional requirements. It is important that the spiral line pulse generator 12 have a compact physical size. Furthermore, the spiral line pulse generator 12 must be capable of withstanding the considerable heat generated by the discharge lamp. In a typical application, the spiral line pulse generator 12 must be capable of operation at 200° C.

It is to be understood that practical spiral line pulse generators, due to certain inefficiencies, provide output pulses of lower amplitude than the theoretical value given by equation (1) above. However, it has been determined that above a minimum pulse amplitude the energy content, rather than the amplitude or pulse width, of the spiral line pulse generator output pulse is the most important factor in effective starting of high pressure disharge lamps. The discharge lamp can be started by output pulses of less than ten kilovolts in amplitude by increasing the energy content of the pulse. Since output pulses of maximum amplitude and minimum duration are not necessarily required, the spiral line pulse generator design requirements and the switch speed requirements described hereinabove can be relaxed. Typically, when a charging voltage of 470 volts is used, a voltage multiplication factor between about two and ten is suitable.

In one example of a spiral line pulse generator, the conductors are aluminum foil having a thickness of 0.002" and a width of 0.5" and the insulators are polyimide film dielectric having a thickness of 0.001" and a width of 0.7". The two conductors, separated by the two insulators, are wound on a cylindrical form having a diameter of 1.3". Approximately 60 turns provide a capacitance of approximately 0.1 microfarad. The insulators are wider than the conductors to prevent arcing or direct contact between turns at the edges of the conductors. Typically the voltage, ground, and output connections are made by means of tabs which are spot welded to the conductors during the winding of the spiral line pulse generator. When 470 volts is applied to this spiral line pulse generator, an output pulse of approximately 11 millijoules, sufficient to reliably start a 400 watt metal halide lamp, is provided.

The low inductance switch 14, which is shown in FIG. 2 connected between the conductors 30 and 32 on the innermost turn of the spiral line pulse generator 12, can alternatively be connected between the conductors 30 and 32 on the outermost turn at or near the points 42 and 46 or between the conductors 30 and 32 at the midpoint of the conductors 30 and 32. While the output voltage can be taken between any two points on the spiral line pulse generator 12, the maximum voltage multiplication factor is obtained when the output is taken between the innermost turn and the outermost turn.

Figure 7:
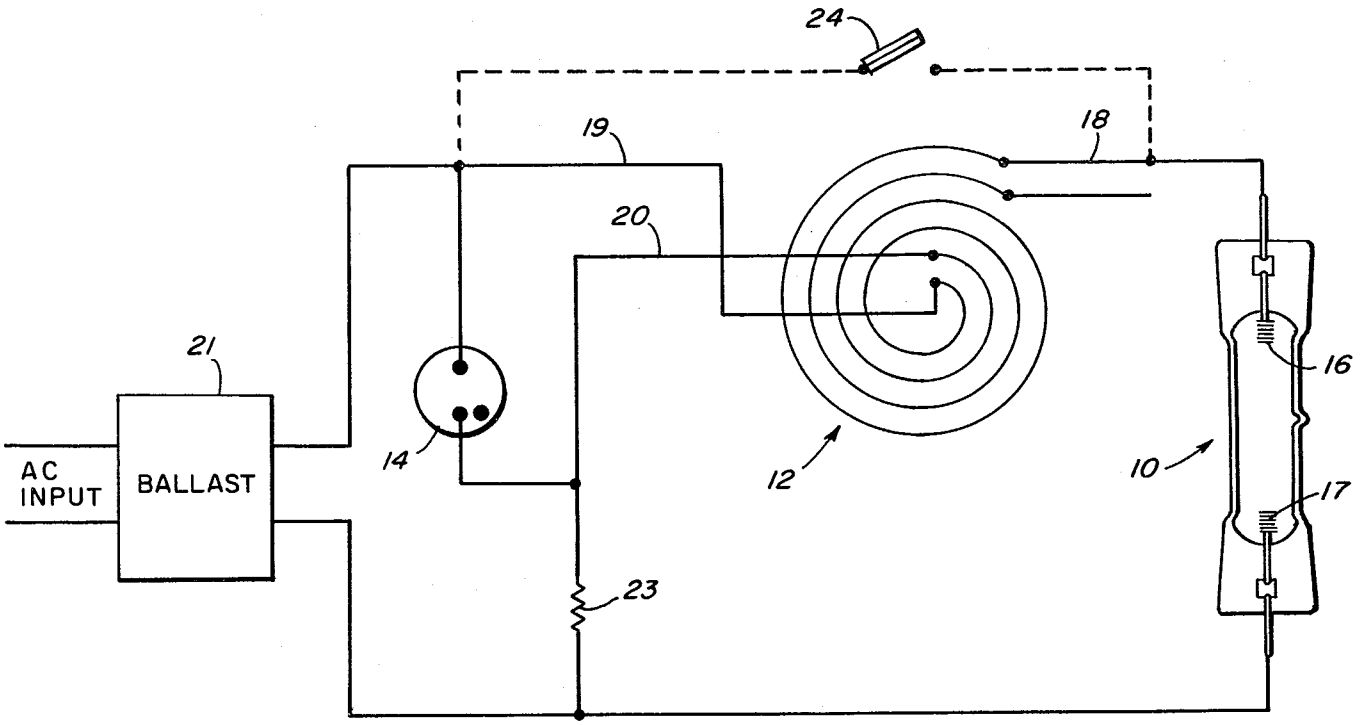
FIG. 7 shows the preferred embodiment of the light source of FIG. 1.

Turning ahead to FIG. 7, the switch 14 is preferably a spark gap. The spark gap is a two terminal device which is normally an open circuit. The spark gap switches to a short circuit when a voltage greater than a predetermined firing voltage is applied to the device causing breakdown. A typical ballast 21 suitable for operating a 400 watt metal halide lamp has a peak output voltage of approximately 600 volts. The predetermined firing voltage of the spark gap is selected to be somewhat lower than the peak ac voltage but higher than the normal discharge voltage of lamp 10 so that the spiral line pulse generator 12 can provide a high energy output pulse. A suitable spark gap is a type CG470L supplied by C. P. Clare division of General Instrument Corp., which has a firing voltage of 470 volts.

Figure 5A:
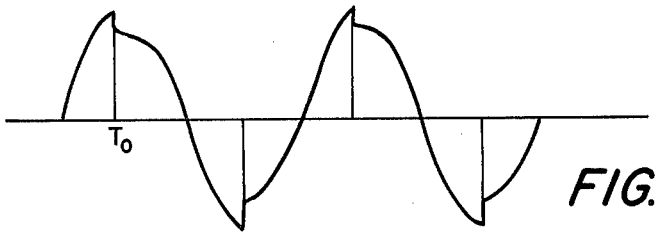
FIG. 5 is a graphic representation of voltage waveforms which occur in the light source of FIG. 1 when the spiral line pulse generator is switched by a spark gap.
Figure 5B:
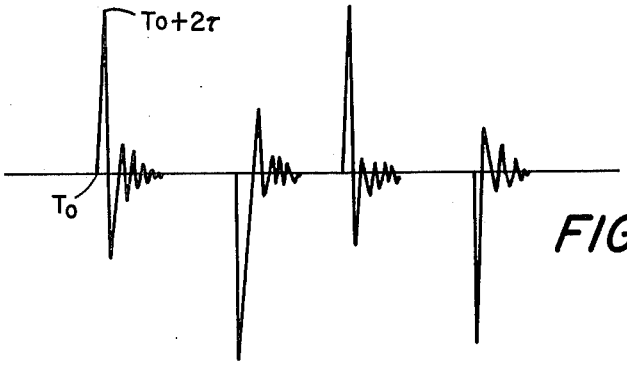

In operation, the ac output voltage of the ballast 21 is applied between the input terminal 19 of the spiral line pulse generator 12 and the electrode 17 of the discharge lamp 10. The ac output voltage of the ballast 21 is also applied to the input terminal 19 and through the resistor 23 to the input terminal 20 of the spiral line pulse generator 12. Referring now to FIG. 5A, the voltage across the spiral line pulse generator 12 increases until the firing voltage of the spark gap (the switch 14) is reached at time $T_0$. The spark gap rapidly short circuits the spiral line pulse generator 12 and a high voltage, short duration pulse, illustrated in FIG. 5B, is provided at the output of the spiral line pulse generator 12 at time $T_0+2\tau$, as described hereinabove. By repetition of this process, a high voltage pulse is produced by the spiral line pulse generator 12 on each half cycle of the ac input voltage, as shown in FIG. 5B, until a discharge is initiated in the discharge lamp 10. After a discharge is established in the discharge lamp 10, the voltage supplied by the lamp ballast 21 is reduced to the normal discharge voltage of lamp 10, which is below the spark gap's firing voltage, so that the spark gap does not fire. Lamp operating power from the ballast 21 is then supplied through the spiral line pulse generator 12 to the discharge lamp 10.

During normal operation of the discharge lamp 10, lamp operating power, which is typically in the range of 1 to 2 amperes, passes through one of the conductors of the spiral line pulse generator. Accordingly, one of the conductors of the spiral line pulse generator must have a sufficiently low value of resistance to avoid significant heating and undesirable voltage drop in the spiral line pulse generator 12. Low resistance can be achieved by increasing the cross-sectional area of the conductor. Alternatively, the thermal switch 24 can be connected between the input terminal 19 and the output terminal 18 of the spiral line pulse generator 12. The thermal switch 24 is located in close proximity to the discharge lamp 10 and is operative to sense the temperature of the discharge lamp 10. When the discharge lamp 10 reaches a predetermined temperature, due to the existence of a discharge therein, the thermal switch 24 closes and effectively bypasses the spiral line pulse generator 12.

An inductor (not shown) can be connected between the output of the ballast 21 and the input terminal 19 of the spiral line pulse generator 12 to block transmission of high voltage pulses, which propagate in the spiral line pulse generator 12, to the lamp ballast 21, thus protecting the ballast 21 against overvoltage pulses. In most cases, however, the switch 14, which is closed during pulse generation, suppresses the high voltage pulses and the inductor is unnecessary.

Figure 6:
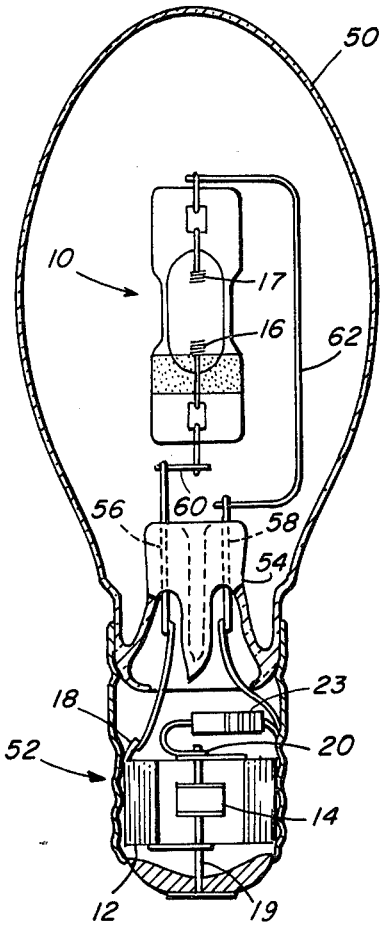
FIG. 6 is a cross-sectional view of a light source according to the present invention wherein the starting circuit is included within the lamp base.

A preferred configuration of the light source shown in FIG. 1 is illustrated in FIG. 6 in simplified form. The discharge lamp 10 is enclosed within a light transmitting outer jacket 50. The lamp starting circuit, including the spiral line pulse generator 12, the switch 14 and the resistor 23, is located in a lamp base 52 attached to the outer jacket 50. Power is received by the lamp base 52 from a source of lamp operating power and is coupled to the starting circuit. Power and starting pulses from the starting circuit are conducted through a lamp stem 54 by conductors 56 and 58. A support member 60 couples power between the conductor 56 and the electrode 16 of the discharge lamp 10. Similarly, a support member 62 couples power between the conductor 58 and the electrode 17 of the discharge lamp 10. The elements of the light source are electrically connected as shown in FIG. 1 and operate as described hereinabove. The discharge lamp 10 is supported in the desired position in the outer jacket 50 by the support members 60,62. Various other discharge lamp support configurations can be utilized without departing from the scope of the present invention.

In another configuration (not shown) of the light source according to the present invention, the starting circuit is enclosed with the discharge lamp within the outer jacket. The starting circuit is located near the lamp base to minimize blockage of light emitted by the discharge lamp. One disadvantage of this configuration is that the starting circuit can, in some cases, when elevated to or near the lamp operating temperature, emit materials which adversely affect discharge lamp operation.

Thus, there is provided by the present invention a light source wherein a metal halide discharge lamp can be reliably started and operated without any requirement for a starting electrode. The manufacturing cost of the discharge lamp without a starting electrode is reduced and the reliability of the discharge lamp is improved. The starting circuit can be enclosed in the lamp base of a light source of conventional configuration. Thus, the light source described herein can directly replace conventional metal halide light sources.

While there has been shown and described what is at present considered the preferred embodiment of the invention, it will be obvious to those skilled in the art that various changes and modifications may be made therein without departing from the scope of the invention as defined by the appended claims.

What is claimed is:

1. A light source comprising:

a high pressure discharge lamp including a discharge tube having electrodes sealed therein at opposite ends and enclosing a fill material which emits light during discharge; and a starting circuit including a spiral line pulse generator including two conductors and two insulators, each in the form of an elongated sheet, in an alternating and overlapping arrangement which is rolled together in a spiral configuration having a plurality of turns, said spiral line pulse generator including an output terminal coupled to one of said electrodes of said lamp and a pair of input terminals, one of said input terminals and the other of said electrodes of said lamp being adapted for coupling to a source of lamp operating power and for delivering lamp operating power, received from the source, through said spiral line pulse generator to said discharge lamp, means for applying ac voltage between the conductors of said spiral line pulse generator, and a breakdown switch coupled between the conductors of said spiral line generator and arranged to short circuit said conductors at a firing selected to be less than the peak of said ac voltage, and higher than the normal discharge voltage of said lamp whereupon said spiral line pulse generator provides at said output terminal a high voltage, short duration pulse of sufficient energy to initiate discharge in said discharge lamp causing said ac voltage to drop below said firing voltage.

2. The light source as defined in claim 1 wherein said breakdown switch is a spark gap.

3. The light source as defined in claim 1 wherein said discharge lamp is a metal halide discharge lamp.

4. The light source as defined in claim 3 wherein said spiral line pulse generator has a voltage multiplication factor between about two and ten.

5. The light source as defined in claim 1 further including a light transmitting outer jacket enclosing said discharge lamp and including means for coupling power and said pulse through said jacket to said discharge lamp and a lamp base attached to said outer jacket and enclosing said starting circuit, said lamp base being adapted for receiving power from the source of lamp operating power.

6. The light source as defined in claim 5 wherein said discharge lamp is a metal halide discharge lamp.

7. The light source as defined in claim 6 wherein said breakdown switch is a spark gap.

8. The light source as defined in claim 1 wherein one of said conductors of said spiral line pulse generator has sufficiently low resistance to pass the lamp operating current without causing significant temperature rise in said spiral line pulse generator.

9. The light source as defined in claim 8 wherein said means for applying ac voltage includes resistor means coupled between the other input terminal of said spiral line pulse generator and said other electrode of said discharge lamp.

10. The light source as defined in claim 1 further including means for delivering lamp operating power directly to said one electrode of said discharge lamp after initiation of discharge in said discharge lamp.

11. The light source as defined in claim 10 wherein said means for delivering lamp operating power includes a thermal switch which closes when said discharge lamp reaches a predetermined temperature, coupled between said one input terminal and said output terminal of said spiral line pulse generator.

* * * * *